US006439302B1

(12) United States Patent
Wiedemann

(10) Patent No.: US 6,439,302 B1
(45) Date of Patent: Aug. 27, 2002

(54) STRIPPER PACKER

(75) Inventor: Jim Wiedemann, Edmonton (CA)

(73) Assignee: Vanoil Equipment Inc., Leduc (CA)

( * ) Notice: Subject to any disclaimer, the term of this patent is extended or adjusted under 35 U.S.C. 154(b) by 0 days.

(21) Appl. No.: 09/697,406

(22) Filed: Oct. 26, 2000

(30) Foreign Application Priority Data

Jul. 25, 2000 (CA) ..... 2314412

(51) Int. Cl.[7] ..... E21B 33/02; E21B 33/08

(52) U.S. Cl. ..... 166/84.4; 166/85.3; 277/329; 277/518

(58) Field of Search ..... 166/77.2, 77.4, 166/84.4, 85.3, 179; 277/327, 329, 337, 510, 518, 528, 534

(56) References Cited

U.S. PATENT DOCUMENTS 3,897,826 A * 8/1975 Hutchison ..... 166/250.08
4,423,775 A * 1/1984 Wilson ..... 166/84.4
4,923,005 A * 5/1990 Laky et al. ..... 166/335
5,566,753 A * 10/1996 Van Winkle et al. ..... 166/84.1
5,944,099 A * 8/1999 Sas-Jaworsky ..... 166/77.2

OTHER PUBLICATIONS

Texas Oil Tools product information for Coiled Tubing Equipment—Stripper/Packer Systems, printed from the internet, 2 pages, dated prior to Oct. 26, 2000.

* cited by examiner

*Primary Examiner*—David Bagnell
*Assistant Examiner*—Brian Halford
(74) *Attorney, Agent, or Firm*—Christensen O'Connor Johnson Kindness PLLC

(57) ABSTRACT

A stripper packer includes a main body having a first end and a second end. A passage extends through the main body from the first end to the second end, thereby facilitating the passage of coiled tubing through the main body when the coiled tubing is being stripped in and out of a well bore. A primary sealing element encircles the passage. A secondary sealing element encircles the passage. A piston is positioned within the main body. Movement of the piston in a first direction toward the first end of the main body applies a compressive force to the primary sealing element thereby causing the primary sealing element to expand inwardly to form a circumferential seal around the coiled tubing. Movement of the piston in a second direction toward the second end of the main body applies a compressive force to the secondary sealing element thereby causing the secondary sealing element to expand inwardly to form a circumferential seal around the coiled tubing.

5 Claims, 4 Drawing Sheets

STRIPPER PACKER

FIELD OF THE INVENTION

The present invention relates to a stripper packer which is designed to pack-off around coiled tubing being stripped in and out of a well bore.

BACKGROUND OF THE INVENTION

A stripper packer is used to pack-off around coiled tubing being stripped in and out of a well bore. A stripper packer consists of a main body having a first end and a second end. A passage extends from the first end to the second end, through which coiled tubing passes when being stripped in and out of a well bore. An annular sealing element is provided which encircles the passage. A piston is provided to directly or indirectly apply a compressive force to the annular sealing element. When subjected to a compressive force, the annular sealing element expands inwardly to form a circumferential seal around the coiled tubing. Of course, when the annular sealing element becomes worn the stripper packer is no longer capable of providing an effective seal.

SUMMARY OF THE INVENTION

What is required is a stripper packer that has a backup seal which can be used should the annular sealing element become worn and no longer be capable of providing an effective seal.

According to the present invention there is provided a stripper packer which includes a main body having a first end and a second end. A passage extends through the main body from the first end to the second end, thereby facilitating the passage of coiled tubing through the main body when the coiled tubing is being stripped in and out of a well bore. A primary sealing element encircles the passage. A secondary sealing element encircles the passage. A piston is positioned within the main body. Movement of the piston in a first direction toward the first end of the main body applies a compressive force to the primary sealing element thereby causing the primary sealing element to expand inwardly to form a circumferential seal around the coiled tubing. Movement of the piston in a second direction toward the second end of the main body applies a compressive force to the secondary sealing element thereby causing the secondary sealing element to expand inwardly to form a circumferential seal around the coiled tubing.

The stripper packer, as described above, has a built in secondary sealing element when the primary sealing element is no longer effective, the secondary sealing element can be activated to take over the sealing function by merely moving the piston which activates the primary sealing element in the opposite direction.

Although beneficial results may be obtained through the use of the stripper packer, as described above, a preferred configuration involves the use of a pressure member positioned between the primary annular element and the secondary sealing element. The piston is coupled to the pressure member so that movement of the piston in the first direction pulls the pressure member toward the first end of the main body exerting a compressive force upon the primary sealing element thereby causing the primary sealing element to expand inwardly to form a circumferential seal around the coiled tubing. Movement of the piston in a second direction pushes the pressure member toward the second end of the main body exerting a compressive force upon the secondary sealing element thereby causing the secondary sealing element to expand inwardly to form a circumferential seal around the coiled tubing.

Although beneficial results may be obtained through the use of stripper packer, as described above, when the primary sealing element fails it must be replaced. Removal of the stripper packer from the wellhead for replacement of the primary sealing element results in down time for the well. Even more beneficial results may, therefore, be obtained when the primary sealing element is replaceable in situ. According to this aspect of the invention the main body has a primary seal access connection which provides access to the primary sealing element. The primary seal access connection is capable of being separated while the main body is positioned on a wellhead with coiled tubing extending through the passage, thereby permitting the primary sealing element to be removed from the main body and replaced without removing the main body from the wellhead.

Although beneficial results may be obtained through the use of the stripper packer, as described above, eventually the secondary sealing element will also show signs of wear. Even more beneficial results may, therefore, be obtained when the secondary sealing element is also replaceable in situ. According to this aspect of the invention the main body has a secondary seal access connection which provides access to the secondary sealing element. The secondary seal access connection is capable of being separated while the main body is positioned on a wellhead with coiled tubing extending through the passage, thereby permitting the secondary sealing element to be removed from the main body and replaced without removing the main body from the wellhead.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
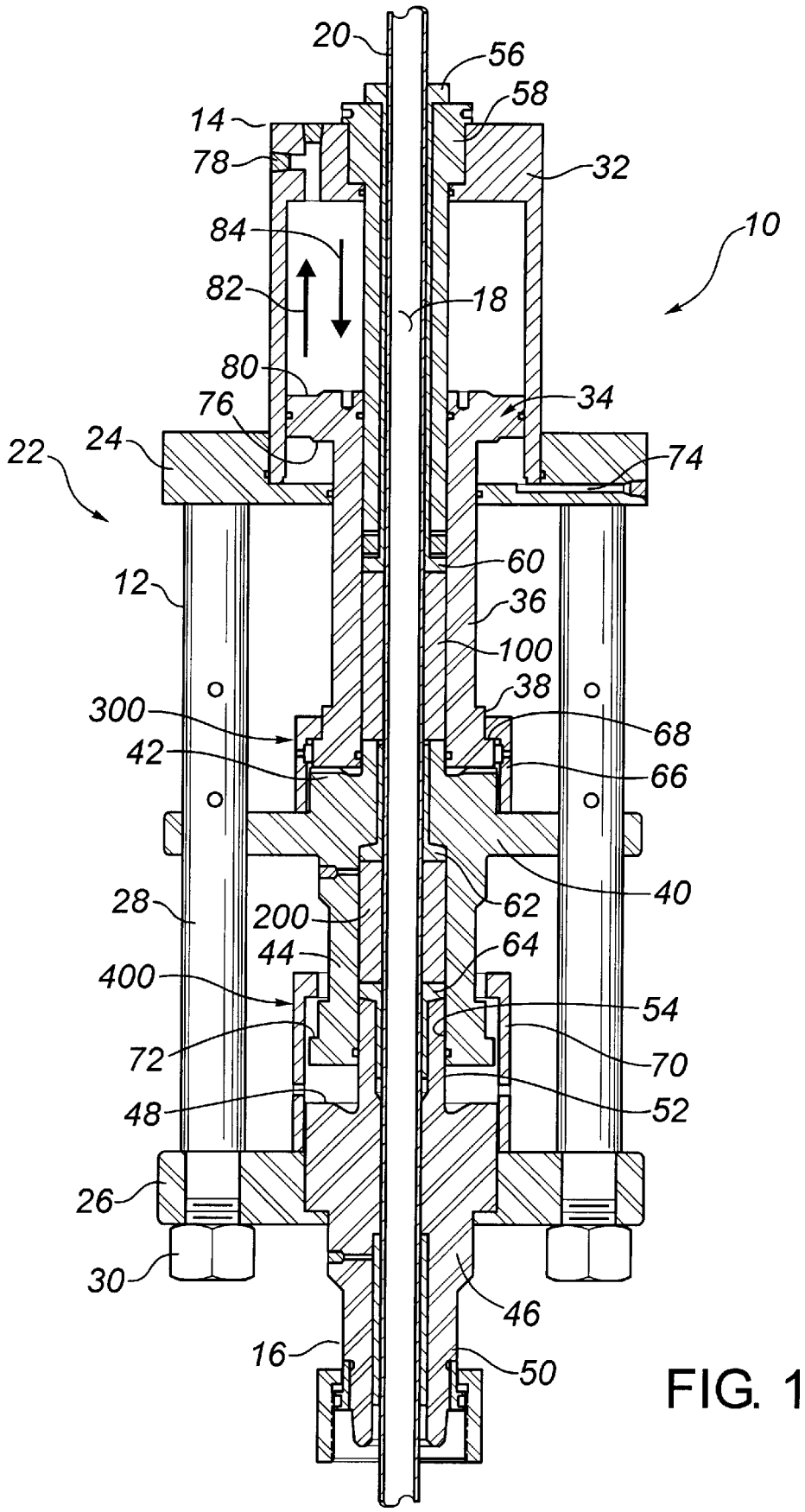
FIG. 1 is a side elevation view, in section, of a stripper packer constructed in accordance with the teachings of the present invention.

The preferred embodiment, a stripper packer generally identified by reference numeral 10, will now be described with reference to FIGS. 1 through 4.

Structure and Relationship of Parts:

Referring to FIG. 1, stripper packer 10 includes a main body 12 which has a first end 14 and a second end 16. A passage 18 extends through main body 12 from first end 14 to second end 16. Passage 18 is used for the passage of coiled tubing 20 through main body 12 when coiled tubing 20 is being stripped in and out of a well bore, as will hereinafter be further described. For convenience when assembling and servicing main body 12, main body 12 is made up of a number of components. Main body 12 includes a main frame, generally indicated by reference numeral 22. Main frame 22 includes a top plate 24 and a bottom plate 26 mounted on support rods 28 with bottom plate 26 being held secured to support rods 28 by nuts 30. An hydraulic cylinder 32 is threadedly secured to top plate 24 to form first end 14 of main body 12. Disposed within hydraulic cylinder 32 is a piston 34. Piston 34 has an elongate extending neck 36 which passes through top plate 24 and terminates in a remote end 38. A pressure member 40 is provided which has a first end 42 and a second end 44. Remote end 38 of neck 36 of piston 34 is coupled to first end 42 of pressure member 40, as will hereinafter be further described. A lower sub 46 extends through bottom plate 26 of main frame 22 and serves as the second end 16 of main body 12. Lower sub 46 has a first end 48 and a second end 50. A male member 52 positioned at first end 48 of lower sub 46 extends into a female receptacle 54 at second end 44 of pressure member 40. Male member 52 and female receptacle 54 enable lower sub 46 and pressure member 40 to maintain engagement while permitting limited relative axial movement. A series of bushings are provided along passage 18. Bushing 56 extends through a bushing sleeve 58 which passes through hydraulic cylinder 32 and into piston 34. Bushing 60 is positioned within piston 34 below bushing sleeve 58. Bushing 62 is positioned within female receptacle 54 of pressure member 40. Bushing 64 is positioned within male member 52 of lower sub 46. A primary sealing element 100 is positioned encircling passage 18 within neck 36 of piston 34 between bushing 60 and first end 42 of pressure member 40. A secondary sealing element 200 is positioned encircling passage 18 within female receptacle 54 of pressure member 40 between bushing 62 and bushing 64. It is to be noted that primary sealing element 100 and secondary sealing element 200 are in spaced relation separated by pressure member 40. An upper collar 66 overlies neck 36 of piston 34 and engages protruding shoulders 68 at remote end 38 of neck 36. Upper collar 66 is threadedly connected to first end 42 of pressure member 40. This connection between upper collar 66 and first end 42 of pressure member 40 serves to couple piston 34 to pressure member 40, so pressure member 40 must move in response to movement of piston 34. This connection also serves as a primary seal access connection, generally indicated by reference numeral 300, which provides access to primary sealing element 100, as will hereinafter be further described. A lower collar 70 overlies pressure member 40 and engages protruding shoulders 72 at second end 44 of pressure member 40. Lower collar 70 is threadedly connected to first end 48 of lower sub 46. This connection between lower collar 70 and first end 48 of lower sub 46 serves as a secondary seal access connection, generally indicated by reference numeral 400, which provides access to secondary sealing element 200, as will hereinafter be further described. In order for hydraulic cylinder 32 to operate, a first hydraulic fluid passage 74 is provided to deliver hydraulic fluid to a first side 76 of piston 34 and a second hydraulic fluid passage 78 is provided to deliver hydraulic fluid to a second side 80 of piston 34. When hydraulic fluid is pumped into hydraulic cylinder 32 on first side 76 of piston 34, piston 34 moves in a first direction, generally indicated by arrow 82, toward first end 14 of housing 12. When hydraulic fluid is pumped into hydraulic cylinder 32 on second side 80 of piston 34, piston 34 moves a second direction, generally indicated by arrow 84, toward second end 16 of housing 12.

Figure 2:
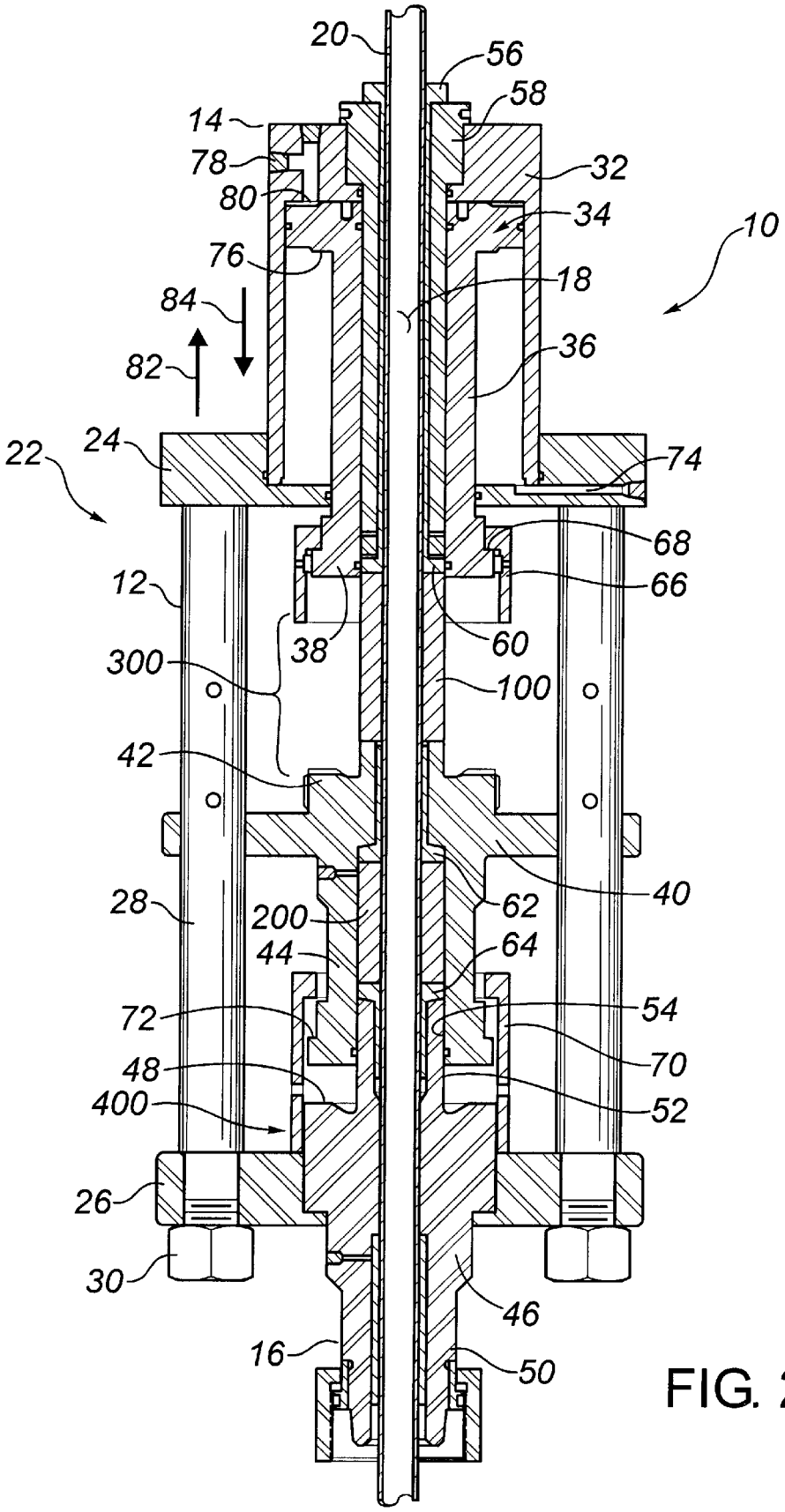
FIG. 2 is a side elevation view, in section, of the stripper packer illustrated in FIG. 1, in the process of removal and replacement of the primary sealing element.
Figure 4:
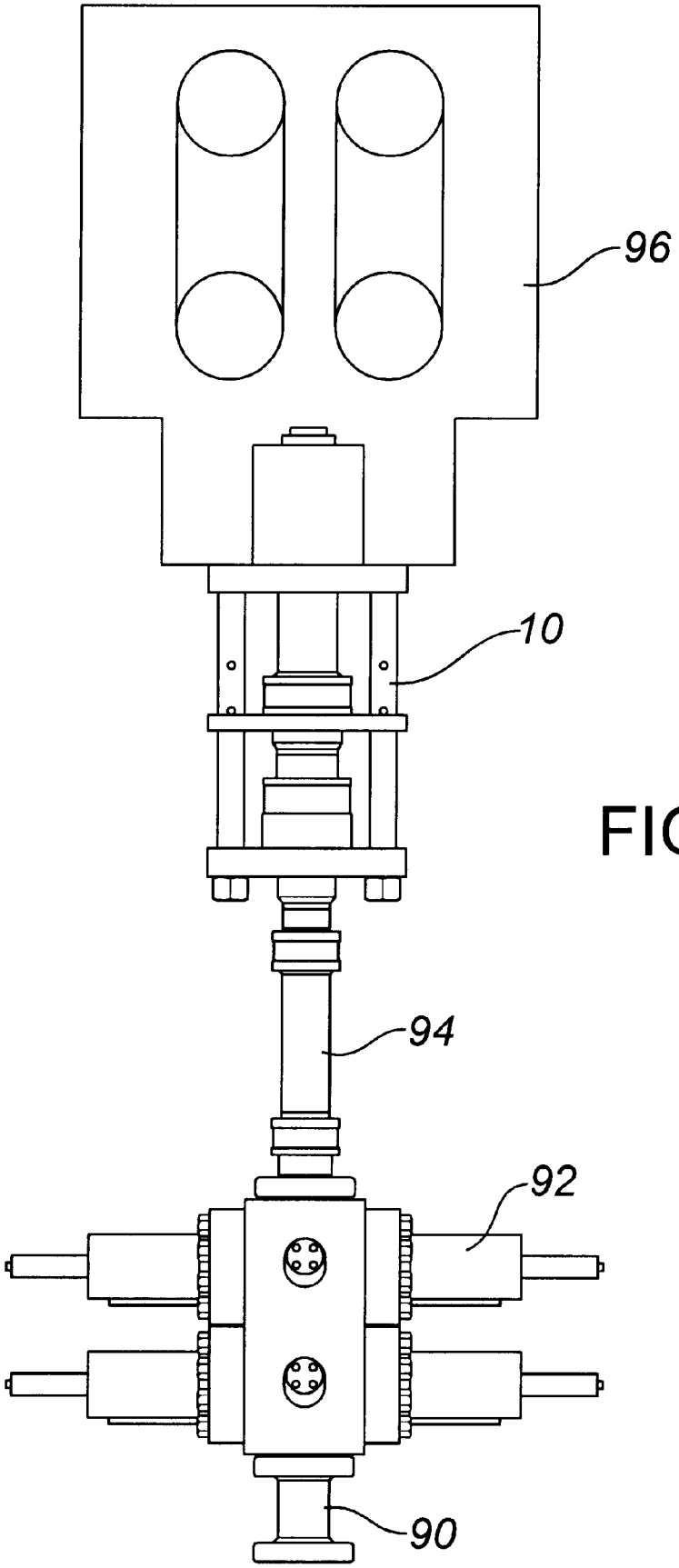
FIG. 4 is a side elevation view of the stripper packer illustrated in FIG. 1, in position on a wellhead.

Operation:

Referring to FIG. 4, there is illustrated stripper packer 10 as it would typically be installed onto a wellhead 90. A blowout preventor 92 is positioned directly onto wellhead 90. A lubricator riser 94 is positioned on top of blowout preventor 92. Stripper packer 10 is positioned on top of lubricator riser 94. A coiled tubing injector 96 is positioned on top of stripper packer 10 and serves to feed coiled tubing 20 into passage 18 as illustrated in FIG. 2. Movement of piston 34 is controlled by hydraulic fluid, as previously described. Movement of piston 34 in first direction 82 pulls pressure member 40 toward first end 14 of main body 12. This compresses primary sealing element 100 between bushing 60 which remains stationary and first end 42 of pressure member 40 which is moving. This compressive force causes primary sealing element 100 to expand inwardly to form a circumferential seal around coiled tubing 20. It also causes primary sealing element 100 to expand outwardly to form a circumferential seal within neck 36 of piston 34. Eventually primary sealing element 100 will show signs of wear, and it will be desirable to shift the sealing function to secondary sealing element 200. Movement of piston 34 second direction 84 pushes pressure member 40 toward second end 16 of main body 12. This compresses secondary sealing element 200 between bushing 62 which is moving and bushing 64 which remains stationary. This compressive force causes secondary sealing element 200 to expand inwardly to form a circumferential seal around coiled tubing 20. It also causes secondary sealing element 200 to expand outwardly to form a circumferential seal within female receptacle 54 of pressure member 40.

Referring to FIG. 2, when primary sealing element 100 is worn it must be replaced. This is accomplished by separating primary seal access connection 300, by unthreading upper collar 66 as illustrated. Once primary seal access connection 300 is separated, piston 34 is moved in the first direction 82 to provide sufficient clearance for the removal of primary sealing element 100. This servicing is performed in situ while main body 12 remains positioned on wellhead 90, as illustrated in FIG. 4.

Figure 3:
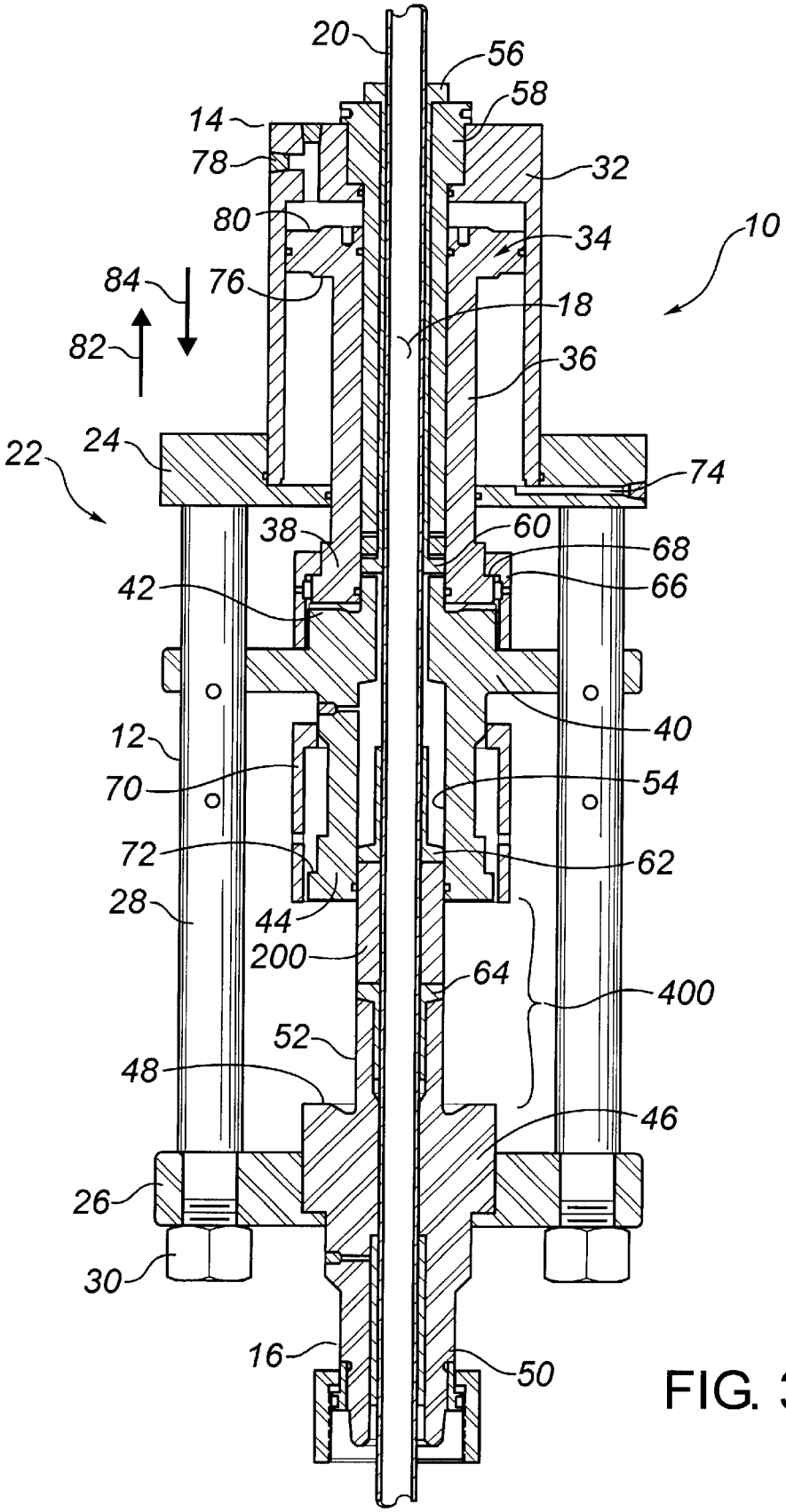
FIG. 3 is a side elevation view, in section, of the stripper packer illustrated in FIG. 1, in the process of removal and replacement of the secondary sealing element.

Referring to FIG. 3, eventually secondary sealing element 200 will show signs of wear and will have to be replaced along with primary sealing element 100. Primary sealing element 100 is first removed, as illustrated and described in relation to FIG. 2. The primary seal access connection 300 is reconnected by actuating piston 34 in direction 84 and threading upper collar 66 to first end 42 of pressure member 40. Then secondary seal access connection 400 is separated by unthreading lower collar 70 from first end 48 of lower sub 46. Piston 34 is used to lift pressure member 40 into the space formerly occupied by primary sealing element 100, in order to provide necessary clearance for the removal of secondary sealing element 200. This servicing is performed in situ while main body 12 remains positioned on wellhead 90, as illustrated in FIG. 4.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A stripper packer, comprising:

a main body having a first end and a second end;

a passage extending through the main body from the first end to the second end, thereby facilitating the passage of coiled tubing through the main body when the coiled tubing is being stripped in and out of a well bore;

a primary sealing element encircling the passage;

a secondary sealing element encircling the passage;

a piston positioned within the main body, movement of the piston in a first direction toward the first end of the main body applies a compressive force to the primary sealing element thereby causing the primary sealing element to expand inwardly to form a circumferential seal around the coiled tubing, and movement of the piston in a second direction toward the second end of the main body applies a compressive force to the secondary sealing element thereby causing the secondary sealing element to expand inwardly to form a circumferential seal around the coiled tubing.

2. The stripper packer as defined in claim 1, wherein a pressure member is positioned between the primary sealing element and the secondary sealing element, movement of the piston in the first direction pulls the pressure member toward the first end of the main body exerting a compressive force upon the primary sealing element thereby causing the primary sealing element to expand inwardly to form a circumferential seal around the coiled tubing, and movement of the piston in a second direction pushes the pressure member toward the second end of the main body exerting a compressive force upon the secondary sealing element thereby causing the secondary sealing element to expand inwardly to form a circumferential seal around the coiled tubing.

3. The stripper packer as defined in claim 1, wherein the main body has a primary seal access connection which provides access to the primary sealing element, the primary seal access connection being capable of being separated while the main body is positioned on a wellhead with coiled tubing extending through the passage, thereby permitting the primary sealing element to be removed from the main body and replaced without removing the main body from the wellhead.

4. The stripper packer as defined in claim 1, wherein the main body has a secondary seal access connection which provides access to the secondary sealing element, the secondary seal access connection being capable of being separated while the main body is positioned on a wellhead with coiled tubing extending through the passage, thereby permitting the secondary sealing element to be removed from the main body and replaced without removing the main body from the wellhead.

5. A stripper packer, comprising:

a main body having a first end and a second end;

a passage extending through the main body from the first end to the second end, thereby facilitating the passage of coiled tubing through the main body when the coiled tubing is being stripped in and out of a well bore;

a primary sealing element encircling the passage;

a secondary sealing element encircling the passage;

a pressure member positioned between the primary sealing element and the secondary sealing element;

a piston positioned coupled to the pressure member, movement of the piston in the first direction pulls the pressure member toward the first end of the main body exerting a compressive force upon the primary sealing element thereby causing the primary sealing element to expand inwardly to form a circumferential seal around the coiled tubing, and movement of the piston in a second direction pushes the pressure member toward the second end of the main body exerting a compressive force upon the secondary sealing element thereby causing the secondary sealing element to expand inwardly to form a circumferential seal around the coiled tubing;

a primary seal access connection in the main body which provides access to the primary sealing element, the primary seal access connection being capable of being separated while the main body is positioned on a wellhead with coiled tubing extending through the passage, thereby permitting the primary sealing element to be removed from the main body and replaced without removing the main body from the wellhead; and a secondary seal access connection in the main body which provides access to the secondary sealing element, the secondary seal access connection being capable of being separated while the main body is positioned on a wellhead with coiled tubing extending through the passage, thereby permitting the secondary sealing element to be removed from the main body and replaced without removing the main body from the wellhead.

* * * * *